United States Patent [19]

Stevens

[11] 4,134,216

[45] Jan. 16, 1979

[54] PRODUCT DRYING APPARATUS

[76] Inventor: Robert D. Stevens, 6614 Horshoe Curve, Excelsior, Minn. 55331

[21] Appl. No.: 852,710

[22] Filed: Nov. 18, 1977

[51] Int. Cl.[2] ..... F26B 21/06

[52] U.S. Cl. ..... 34/77; 34/27

[58] Field of Search ..... 34/77, 27, 32, 225, 34/35; 62/238

[56] References Cited

U.S. PATENT DOCUMENTS

| | | | |
|---|---|---|---|
| 1,119,011 | 12/1914 | Grosvenor | 34/77 |
| 4,043,051 | 8/1977 | Lussenden | 34/229 X |

*Primary Examiner*—Benjamin R. Padgett
*Assistant Examiner*—E. Suzanne Parr
*Attorney, Agent, or Firm*—Leo Gregory

[57] ABSTRACT

An apparatus for removing moisture from a moisture containing product in which the improvement consists of removing latent heat from the moisture removed from the product and reintroducing the latent heat as sensible heat to heat the air stream which is used to remove the moisture from the product, thus providing a continuous closed cycle drying process which includes its own heat supply.

4 Claims, 2 Drawing Figures

PRODUCT DRYING APPARATUS

BACKGROUND OF THE INVENTION

1. Field of the Invention

This invention relates to a method and apparatus for drying a moisture laden product such as grain and utilizing the latent heat in the moisture extracted by means of a refrigeration coil and a compressor and converting it by a condensing coil to sensible heat for use in the drying process.

2. Description of the Prior Art

Prior art devices have been found to require in a product drying operation the use of outside air, the use of an auxiliary source of moisture and auxiliary heating means. In Clark, U.S. Pat. No. 3,739,487 use is made of an external supply of air and a desiccant as an absorbing agent; in Luckenback, U.S. Pat. No. 212,955 moisture removed from a product is frozen, then melted and a furnace is required for a heat source; in Grosvenor, U.S. Pat. No. 1,119,011 both external heat and cooling sources are required; in Hermes, U.S. Pat. No. 2,570,808 heat is exhausted to the atmosphere; and in Elwess, U.S. Pat. No. 2,799,947 air is exhausted to the atmosphere and outside air is used.

SUMMARY OF THE INVENTION

The basic premise of this invention is that the moisture extracted from a product which requires drying serves as a heat source and provides the heat required to heat the air used in the drying process permitting a self contained apparatus for a closed system drying operation. Prior art devices as above described have been found to require in a product drying operation the use of outside air, the use of an auxiliary source of moisture and auxiliary heating means. The structure and process herein are clearly distinguishable from the prior art in comprising a closed system drying operation wherein an adequate supply of heat is secured from the latent heat in the moisture extracted from the product and this heat converted into sensible heat is sufficient to support the drying process.

It is an object of this invention, therefore, to provide an apparatus to extract heat from a moisture laden product and to utilize the heat in the moisture extracted to support the drying process in a closed system operation.

It is another object of this invention to provide an apparatus to extract moisture from a moisture laden product and to convert the latent heat in the moisture extracted into sensible heat to be used as the total heat source for the drying process.

It is another object of this invention to provide an apparatus to extract moisture from a moisture laden product and to extract the latent heat from the moisture extracted from the product by reducing the temperature of the moisture extracted below its dew point by means of a refrigeration coil and compressor and by reintroducing the heat removed from said moisture into the drying operation through a condensing coil and this converts latent heat extracted from said moisture into sensible heat which provides the heat to support the drying process.

It is another object of this invention to provide an apparatus having a closed circuit communication with a product bin and which by means of movement of air extracts the moisture from the moisture laden product contained in the bin, moves the air through an evaporator coil to remove the water from said air, picks up the heat from the moisture in said air transferring the heat removed from said air to a condensor and reintroducing said heat into the air stream used in the drying process by use of said condensor whereby a closed system product drying apparatus and method is provided.

These and other objects and advantages of the invention will be set forth in the following description made in connection with accompanying drawings in which like reference characters refer to similar parts throughout the several views thereof.

DESCRIPTION OF THE DRAWINGS

FIG. 1 is a view in side elevation with some portions being in vertical section.

DESCRIPTION OF A PREFERRED EMBODIMENT

Figure 2:
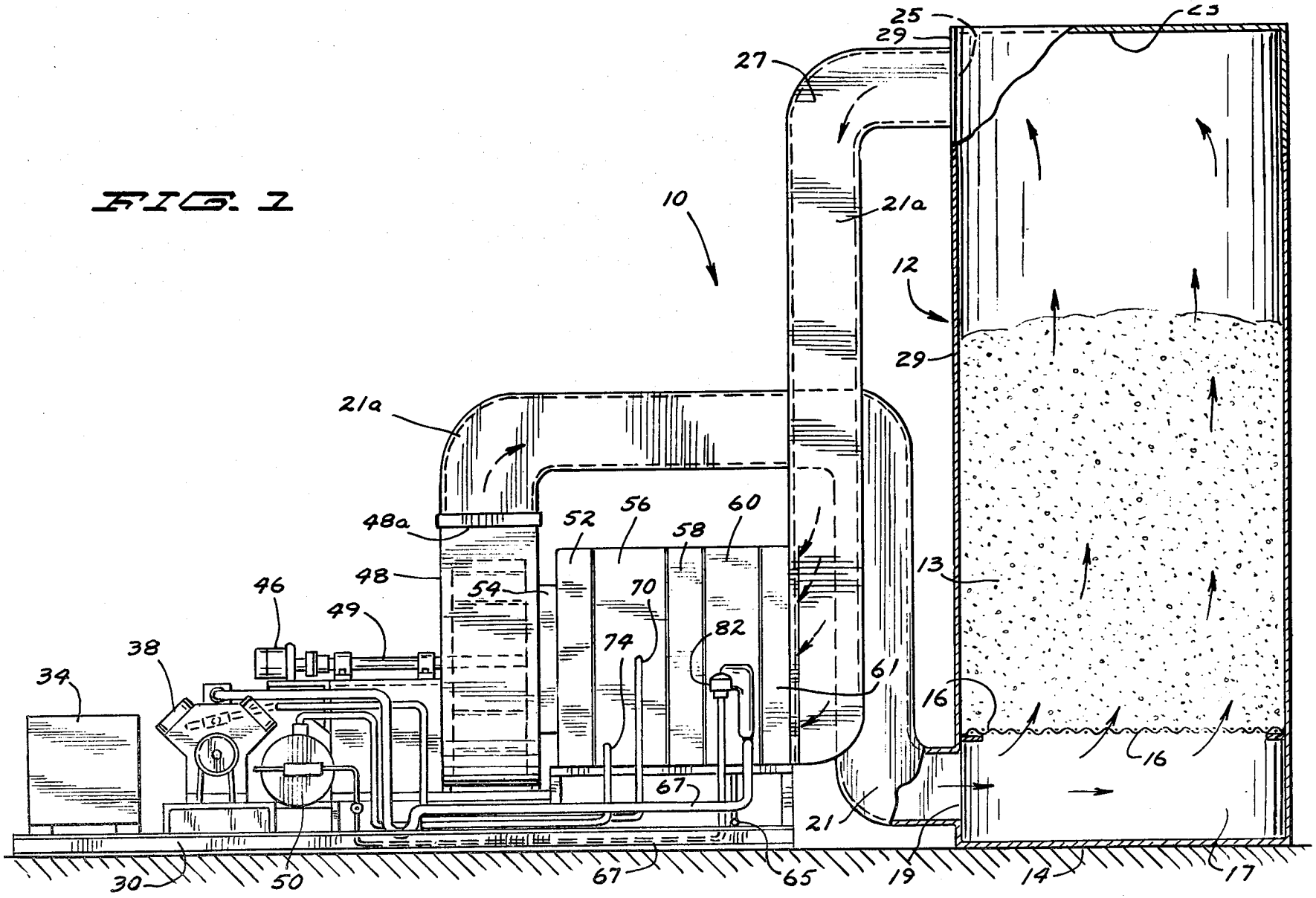
FIG. 2 is a top plan view with a portion being broken away.
Figure 2:
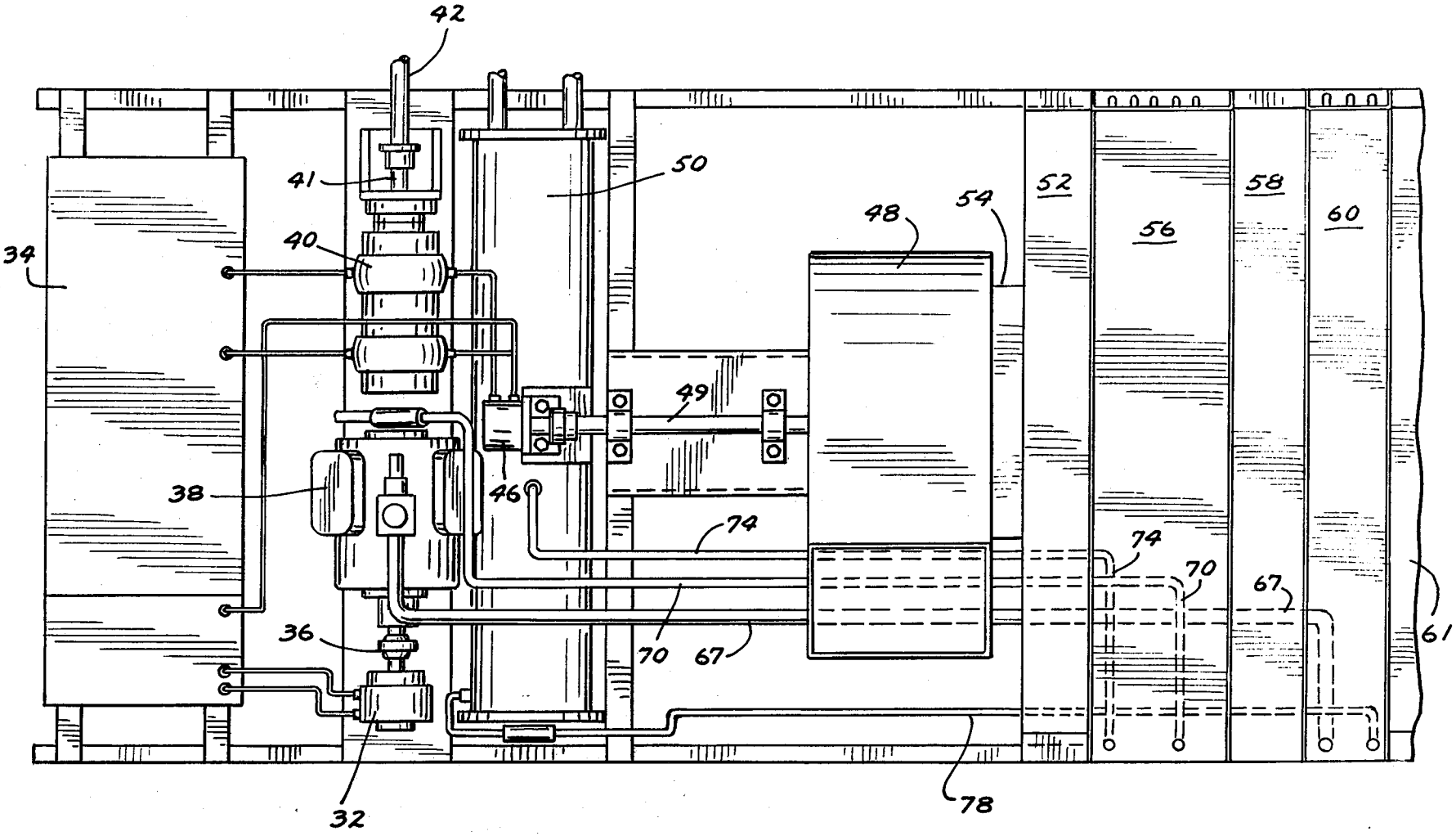

Referring to the drawings, the product drying apparatus 10 comprising the invention herein is shown for purpose of illustration in connection with what is indicated as being a conventional type of a drying bin 12 comprising a sealed housing 13 used for drying agricultural products such as corn.

Said bin is not shown in detail being of a conventional design and will have disposed therein commonly used means for tumbling or agitating the product contents such as an endless screw member. Said bin is shown having an imperforate bottom plate 14 with a perforate plate 16 spaced thereabove forming a chamber 17 therebetween having an inlet port 19 to which is connected an air supply conduit 21.

The ceiling or top wall plate 23 of said housing has a vent or outlet port 25 in an adjacent wall portion 29 to which is connected a discharge air conduit 27.

Said conduits 21 and 27 are operatively connected with said apparatus 10 as will be described.

Said apparatus 10 is here shown erected for support upon a plate member 30 for portability as the entire plate member and the apparatus thereon may be raised and set upon a trailer or a truck body. Portability of the apparatus is an important element such as for custom grain drying purposes where the apparatus will be moved from one farm to another.

The apparatus here described is indicated embodying the use of hydraulic pumps and motors, however, other power means such as electric motors are within the inventive concept.

Shown is a hydraulic motor 32 being supplied by hydraulic fluid from a reservoir 34 and by a suitable flexible coupling 36 said motor drives a compressor 38 of conventional design characterized here as a 25 ton compressor.

Also supplied by said reservoir is a hydraulic pump 40.

The supply and return lines for the hydraulic system are conventional, their arrangement is well known in the art, they are indicated generally but are not further described.

Various sources of prime power may be used. For purposes herein a prime power source may very well be a diesel engine such as of a farm tractor which is not shown except for the connecting driving member in the form of a power take off (PTO) indicated at 42 driving the pump 40 by connection with the pump drive shaft 41.

The hydraulic pump 40 by appropriate supply lines will drive the hydraulic motor 46 which drives the blower 48 by means of a suitable coupling 49. Said blower 48 has the inlet end 21*a* of the supply conduit 21 connected its outlet 48*a* by a sealed connection.

Conveniently positioned adjacent said compressor 38 is a water cooled condensor-receiver 50.

In association with said blower 48 is a plenum 52 spaced therefrom by an air passage conduit 54. Adjacent said plenum remote from said blower is an air cooled condensor 56.

Spaced from said air cooled condensor 56 is an evaporator 60. Though not here shown, said evaporator may have a suitable filter overlying the inlet side portion thereof to trap contaminants which may be present in the incoming stream of the air passing from said product bin 12 through said conduit 27 by action of the blower 48. Said conduit is indicated as being connected to a manifold 61 which will form an overlying cap or cover over the incoming side of said evaporator.

The elements of said apparatus 10 as above and hereinafter indicated are shown diagramatically as the same are conventional refrigeration system or equipment components and are known in the art and further description than here given is not deemed necessary.

A liquid line 78 from the condensor-receiver 50 passes refrigerant to the evaporator 60 through an expansion valve 82 which releases the refrigerant as a gas or vapor through the coils which make up said evaporator. The moisture in the incoming stream of air condenses upon striking or engaging the coils of the evaporator and the resulting condensate is discharged through on an appropriate outlet or drain 65. The heat extracted from said incoming air is picked up by the vaporized refrigerant and is returned to the compressor 38 by means of the suction line 67.

The blower 48 draws the incoming air thus dehumidified through said evaporator and through the air space 58 into engagement with the air cooled condensor 56.

A hot gas line 70 runs from the outlet side of the condensor 38 to the coil which makes up the air cooled compressor 56 for the purpose of heating the dehumidified air passing to said condensor from said evaporator 60. The gas or vapor of said line 70 is returned to the inlet side of the condensor-receiver 50 by a line 74 for a completed cycle.

The air heated in passing through the condensor 56 is drawn through the plenum 52 and the conduit 54 by the blower 48 to be blown or passed through the conduit 21 into and through the incoming port 19 of said drying bin and to pass through the contents of said bin to extract moisture from the product within. Thus a complete drying cycle has been described.

It will be noted that what is used here is a closed self-contained system for circulating air with no outside air being drawn into the system. The elements 52–61 have sealed abutting engagement to prevent the entry of outside or ambient air. A unitary enclosing housing may be used but is not here shown.

By way of further description with the apparatus herein being indicated as moving in connection therewith a 25 ton capacity compressor that there will be a circulation of a volume of air of approximately 6,000 CFM and that within a 24 hour period a quantity on the order of 4,000 bushels of product in the drying bin, such as corn, may be reduced in moisture content from an original or field moisture content on the order of 26.5% to 27.5% to a suitable storage moisture content of approximately 13.5%. The use of the closed system herein excludes outside air and avoids having to handle the humidity which outside air would bring into the process.

It has been estimated that prior art drying methods or apparatus have an average cost factor for drying grain products of approximately 12 cents per bushel wherein by comparison the process herein described in view of the experience with it indicates a cost factor for drying on the order of 2.5 cents per bushel or on the order of 20 percent of the prior art cost.

The air heated in the process which is passed through the drying bin is on the order of 110° F.

One of the salient features of the apparatus and process described herein is present in the fact that no outside or auxiliary heat is required to heat the air which is passed through the drying bin. The moisture removed from the product in the product bin has a sufficient latent heat content and by extracting that heat and putting it to use and sensible heat in reheating the air which is passed out through the conduit 21 in the drying process, there is sufficient heat developed to heat air without requiring any outside heat source. Not only is the latent heat utilized from the moisture removed from the product being dried but also added to this heat is the heat of compression from the operation of the apparatus.

The apparatus has been tested and found to perform as the manner as indicated.

It will of course be understood that various changes may be made in the form, details, arrangement and proportions of the product and in the steps and sequence of steps of the method without departing from the scope of applicant's invention which, generally stated, consists in a product and method capable of carrying out the objects above set forth, such as disclosed and defined in the appended claims.

What is claimed is:

1. A particulate product drying apparatus utilizing heat from the moisture removed from a moisture laden product contained within a sealed product drying bin to heat the air used to remove moisture from said product, having in combination a conduit forming an air supply inlet into said product drying bin and a discharge air conduit respectively being secured to the inlet and outlet ports of a sealed product drying bin, a blower having sufficient air moving capacity to pass air through said product bin, means driving said blower, a hot gas evaporator substantially parallelepiped in form disposed in an upstanding position communicating with said discharge air conduit and receiving air passing through said drying bin, means comprising a passage forming an interface between said evaporator and said discharge air conduit and said passage being of a size substantially the extent of the adjacent side of said evaporator, an air cooled condensor of a like size as said evaporator disposed in a parallel spaced facing relation thereto, means comprising a passage for communication between said evaporator and said condensor, means comprising a passage between said condensor and inlet side of said blower, said passage being of like extent as the adjacent side of said condensor, means sealing said evaporator, condensor and said related passages in connection with said blower against the entry of outside air, means passing a gas or vapor through said evaporator condensing the moisture from the incoming air discharged from said product bin by action of said blower and extracting the heat from said air, means passing the heat from said moisture laden air to heat the coils of said condensor heating the dehumidified air drawn by said blower into said condensor from said evaporator, said blower drawing heated dehumidified air into its inlet side from said condensor, and means passing said dehumidified air from said blower into the inlet port of said drying bin.

2. The structure set forth in claim 1, wherein said blower has a capacity to move air on the order of 6,000 C.F.M. through said product bin.

3. The structure set forth in claim 1, wherein said blower has such a capacity to pass air through said product bin as to provide for sufficient extraction of heat to heat said air upon being dehumidified and raising it to such a temperature as to be sufficient to collect moisture in again passing through said product bin.

4. The structure set forth in claim 1, wherein said last mentioned means heats said dehumidified air to on the order of 110° F.

* * * * *